US007180456B2

(12) United States Patent
Sankaranarayanan

(10) Patent No.: US 7,180,456 B2
(45) Date of Patent: Feb. 20, 2007

(54) ANTENNAS SUPPORTING HIGH DENSITY OF WIRELESS USERS IN SPECIFIC DIRECTIONS

(75) Inventor: Ravishankar Sankaranarayanan, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 118 days.

(21) Appl. No.: 10/757,987

(22) Filed: Jan. 16, 2004

(65) Prior Publication Data

US 2005/0156800 A1 Jul. 21, 2005

(51) Int. Cl.
*H01Q 19/06* (2006.01)

(52) U.S. Cl. ..... 343/754; 343/753

(58) Field of Classification Search ..... 343/700 MS, 343/753, 754, 872, 911 R, 911 L
See application file for complete search history.

(56) References Cited

U.S. PATENT DOCUMENTS

| | | | | |
|---|---|---|---|---|
| 4,472,719 | A * | 9/1984 | Hills | 342/15 |
| 4,488,156 | A * | 12/1984 | DuFort et al. | 343/754 |
| 5,185,613 | A * | 2/1993 | Whatmore et al. | 343/909 |
| 5,815,121 | A * | 9/1998 | Collier | 343/756 |
| 5,977,904 | A * | 11/1999 | Mizuno et al. | 342/70 |
| 6,246,369 | B1 * | 6/2001 | Brown et al. | 343/700 MS |
| 6,480,167 | B2 * | 11/2002 | Matthews | 343/795 |

OTHER PUBLICATIONS

Ravishankar and Narasimhan, "Multiple Scattering of EM waves by Dielectric Spheres located in the near field of a source of radiation", IEEE Transactions on Antennas and Propagation, vol. AP35, No. 4, pp. 399-405, Apr. 1987.

C.A.Fernandes, "Shaped Dielectric lenses for Wireless Millimeter-Wave Applications", IEEE Antennas & Propagation Magazine, vol. 41, No. 5, pp. 141-151, Oct. 1999.

C.A.Fernandes, Jose G Fernandes, "Performance of Lens Antennas in wireless Indoor Millimeter Wave Applications", IEEE Transactions on Microwave Theory and Techniques, vol. 47, No. 6, pp. 732-737, Jun. 1999.

Mario GMV Silveirinha, C.A.Fernandes, "Shaped Double-Shell Dielectric Lenses for Wireless millimeter wave applications", IEEE Transactions on Antennas and Propagation Society International Symposium, 2000., vol. 3, No. 16-21, pp. 1674-1677, Jul. 2000.

* cited by examiner

*Primary Examiner*—Shih-Chao Chen
(74) *Attorney, Agent, or Firm*—Steven A. Shaw; W. James Brady; Frederick J. Telecky, Jr.

(57) ABSTRACT

A low cost antenna in a base station suitable for deployment where high density of wireless users are present in specific directions (e.g., cross roads in urban areas). A lens is used associated with antenna elements to collimate the beam for a longer distance in the desired directions. By using the lens, the need for complex electronics is minimized, thereby reducing the cost of a base station. Another aspect of the present invention enables the lens to be designed precisely by first determining the radiation pattern of each array element according to a corresponding coordinate system, transforming the radiation pattern to a common coordinate system, and determining a composite radiation pattern using the value determined for the common coordinate system. Inverse scattering technique is applied using the composite radiation pattern and the desired collimation pattern to determine the precise shape of the lens.

18 Claims, 3 Drawing Sheets

ANTENNAS SUPPORTING HIGH DENSITY OF WIRELESS USERS IN SPECIFIC DIRECTIONS

BACKGROUND OF THE INVENTION

1. Field of the Invention

The present invention relates to base stations used in wireless communications, and more specifically to antennas supporting high density of users in specific directions.

2. Related Art

An antenna generally refers to a component which is used to send and receive wireless signals. In a typical configuration, the antenna is contained in a base station which transmits and receives voice, data, video, etc., in the form of electromagnetic waves. The base station enables wireless users (or wireless devices, in general) to communicate with various other (mobile devices) users, as is well known in the relevant arts.

Base stations are often employed to ensure that the areas (or users within that area) sought to be covered are within the range of wireless signals transmitted by the corresponding antennas. A wireless signal is generally characterized by illumination (energy intensity) at each point of the covered area, and a threshold level of illumination is generally necessary for coverage to extend to the corresponding point. In addition, higher illumination leads to better signal-to-noise-ratio (SNR), which in turn lead to advantages such as high data transfer rates.

A prior base station may provide for a hemispherical coverage area, with approximately uniform illumination in each segment of the area. Such an approach ensures that users at any portion of the hemispherical area are consistently provided connectivity. However, such a solution may not be suitable in areas where users are present in only small portions of the coverage area (e.g., in rural areas) since electrical power is wasted illuminating portions of the covered area in which users are not present. The antennas used in such base stations are generally referred to as 'normal antennas' (as opposed to smart antennas described below).

Another prior base station may overcome some of such disadvantages by using a 'smart antenna'. Such base stations generally operate by 'learning' the specific direction in which active users are present, and beaming (transmitting) only in the directions in which such users are present. The direction of beaming is often controlled by controlling the phase of the signals emitted by each antenna element (contained in the antenna). By transmitting only in the directions in which active users are present, unneeded wastage of power may be avoided. Thus, smart antennas are generally suitable in coverage areas having low density of subscribers.

One problem with smart antenna-based base stations is that the required electronic circuitry (e.g., to control the antenna elements) may be complex, expensive and/or subject to a poor performance due to manufacturing imperfections, particularly as the base stations working at millimeter wave bands needs to support higher transfer rates.

BRIEF DESCRIPTION OF THE DRAWINGS

The present invention will be described with reference to the following accompanying drawings, described briefly below.

In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE PREFERRED EMBODIMENTS

1. Overview

According to an aspect of the present invention, a lens is provided associated with antenna elements to collimate the corresponding beam in a specific direction in which wireless users are expected to be present. Such a solution is particularly useful in situations such as road intersections where higher density of wireless users can be expected in the direction of the roads.

By decreasing the need for expensive and/or unreliable electronics circuits (such as in the case with smart antennas) for achieving the desired collimation, the overall cost of implementation of the antenna (and thus the base station) may be reduced. The lens can conveniently cover all the array elements as well, thereby serving as a radome which provides physical security for the antenna elements.

Another aspect of the present invention provides a design methodology using which lens can be designed to provide a desired operation at least in situations such as that noted above. The lens may be designed taking into consideration that each array element would be located spatially at a different location (during operation of the antenna). The radiation pattern of each array element is determined in a specific coordinate system having a corresponding origin, but transformed into a common coordinate system (having the corresponding common origin) before determining a composite radiation of the antennas.

The shape of the lens is then determined based on the determined composite radiation and the desired collimation characteristics. Shaping of lens based on such considerations potentially results in accurate beam shaping in the desired pre-specified directions.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well-known structures or operations are not shown in detail to avoid obscuring the invention.

2. Example Environment

Figure 1A:
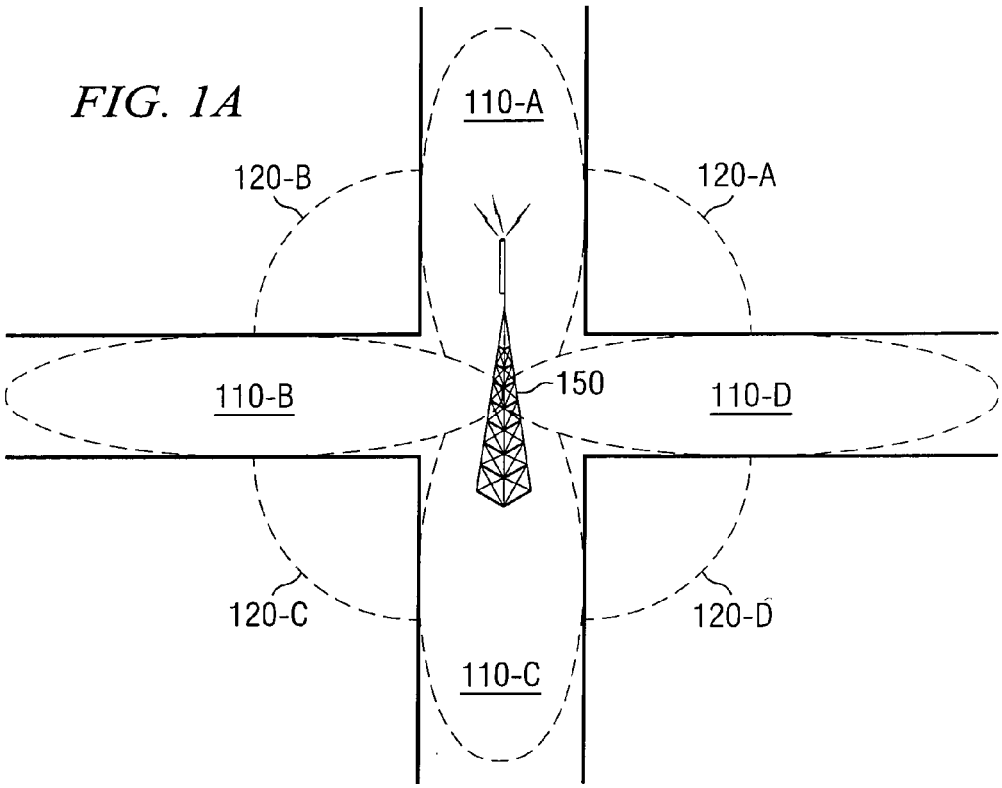
FIG. 1 is an example environment in which the present invention can be implemented.

FIG. 1A is a diagram illustrating the desired illumination coverage in an example scenario. The diagram is shown containing antenna 150 located at the intersection of two cross roads. As may be appreciated, it would be expected that a large number of mobile users will be present along the direction of the road (at least during peak traffic hours).

Accordingly, it may be desirable to collimate the beam generated by the antenna to cover areas 110-A through 110-D. In addition, it may be desirable to provide at least some coverage between the roads, as shown by areas 120-A through 120-D.

Figure 1B:
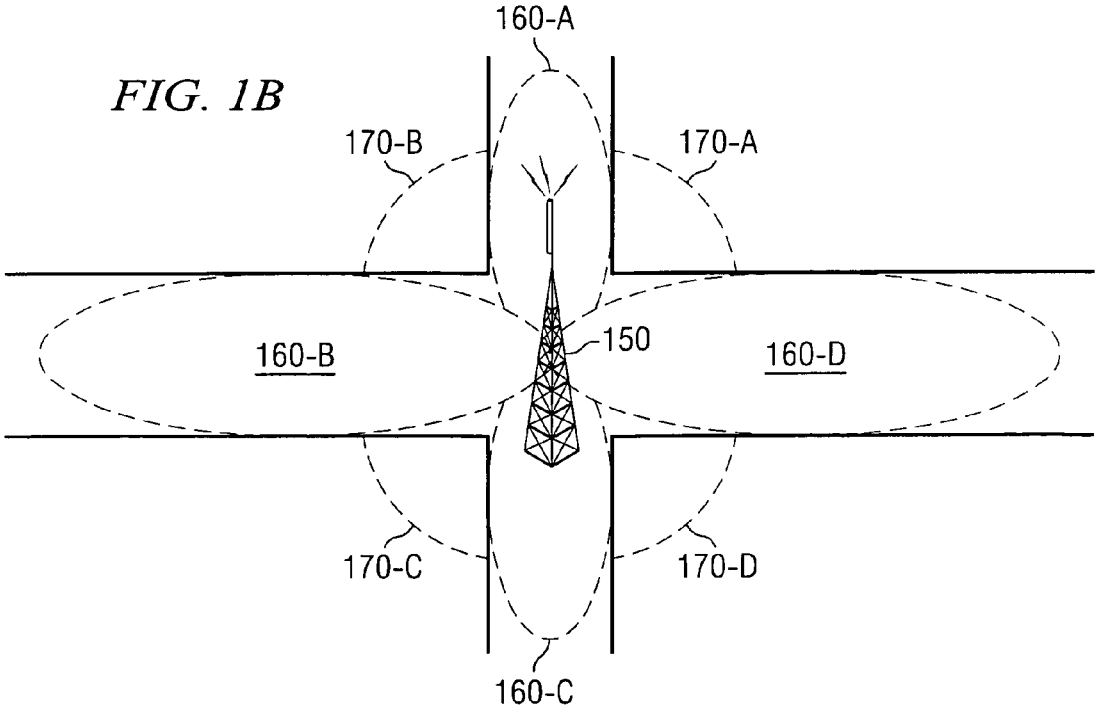

FIG. 1B is a diagram illustrating the desired illumination coverage in an alternative scenario. This diagram also contains antenna 150 located at the intersection of two cross roads. Assuming that one road (covered by areas 160-D and 160-B) has a substantial amount of traffic and another road (covered by areas 160-A and 160-C) has limited traffic, the illumination intensity in each of the areas 160-D and 160-B is higher compared to each of areas 160-A and 160-C. Assuming that substantial coverage in not required except adjacent to the roads (other than close to the intersection), illumination intensity in each of areas 170-A through 170-D is shown lower compared to each of areas The manner in which such coverage (of FIGS. 1A and 1B) can be achieved according to various aspects of the present invention, is described below in further detail.

3. Solution

Figure 2A:
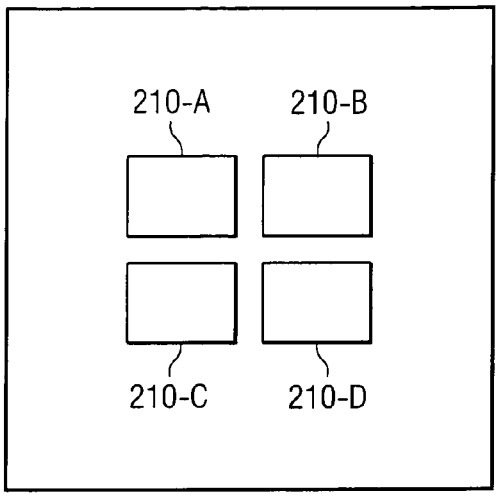
FIG. 2A is a diagram containing array elements of an antenna in one embodiment.
Figure 2B:
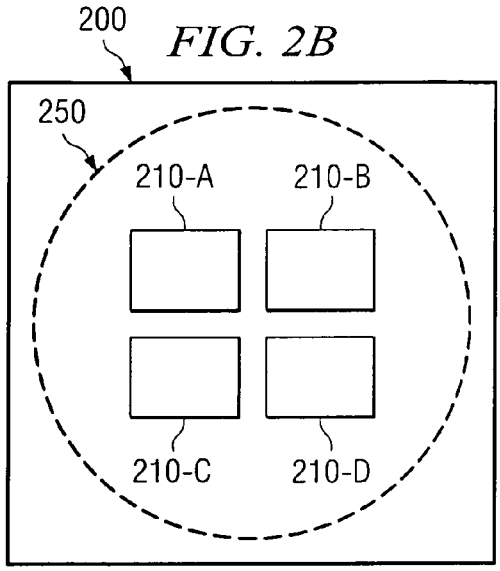
FIG. 2B is a diagram illustrating the manner in which a lens is used in combination with an antenna according to an aspect of the present invention.

FIGS. 2A and 2B together illustrate the general principle using which an antenna may be provided according to various aspects of the present invention. FIG. 2A contains four array elements 210-A through 210-D mounted in the form of a 2×2 array. Antenna elements 210-1 through 210-4 may be implemented in a known way.

FIG. 2B shows a top view with lens 250 covering the four array elements (radiators) to form antenna 200. The area within lens 250 is shown shaded to illustrate that the array elements are entirely covered by lens 250 in the embodiment, thereby potentially serving as a radome as well. The radius of curvature of the lens at each point may be determined by the approach(es) described in sections below.

Lens 250 may be implemented using robust material (or multiple layers) such that it serves also as a radome for the antenna elements 210A through 210D. Lens 250 may be implemented using various approaches. While only a single lens is shown for illustration, it should be appreciated that multiple lenses may be provided for corresponding collimations in different directions.

Lens 250 may be shaped such that the transmissions of the array elements are collimated in a desired manner as described above with reference to FIGS. 1A and 1B. For example, with reference to FIG. 1A, the radius of curvature needs to be more in the direction of each of areas 110-A through 110-D compared to in the direction of each of areas 120-A through 120-D. Similarly, with respect to FIG. 1B, the radius of curvature along each of directions 160-B and 160-D needs to be more than the radius of curvature along of each of directions 160-A and 160-C, which in turn needs to be more than the radius of curvature along each of directions 170-A through 170-D.

Accordingly, lens 250 generally needs to be designed taking into account various considerations. One example approach to designing such lens based on some example considerations is described in sections below. First, an example device using the solution is described below.

4. Example Device

Figure 3:
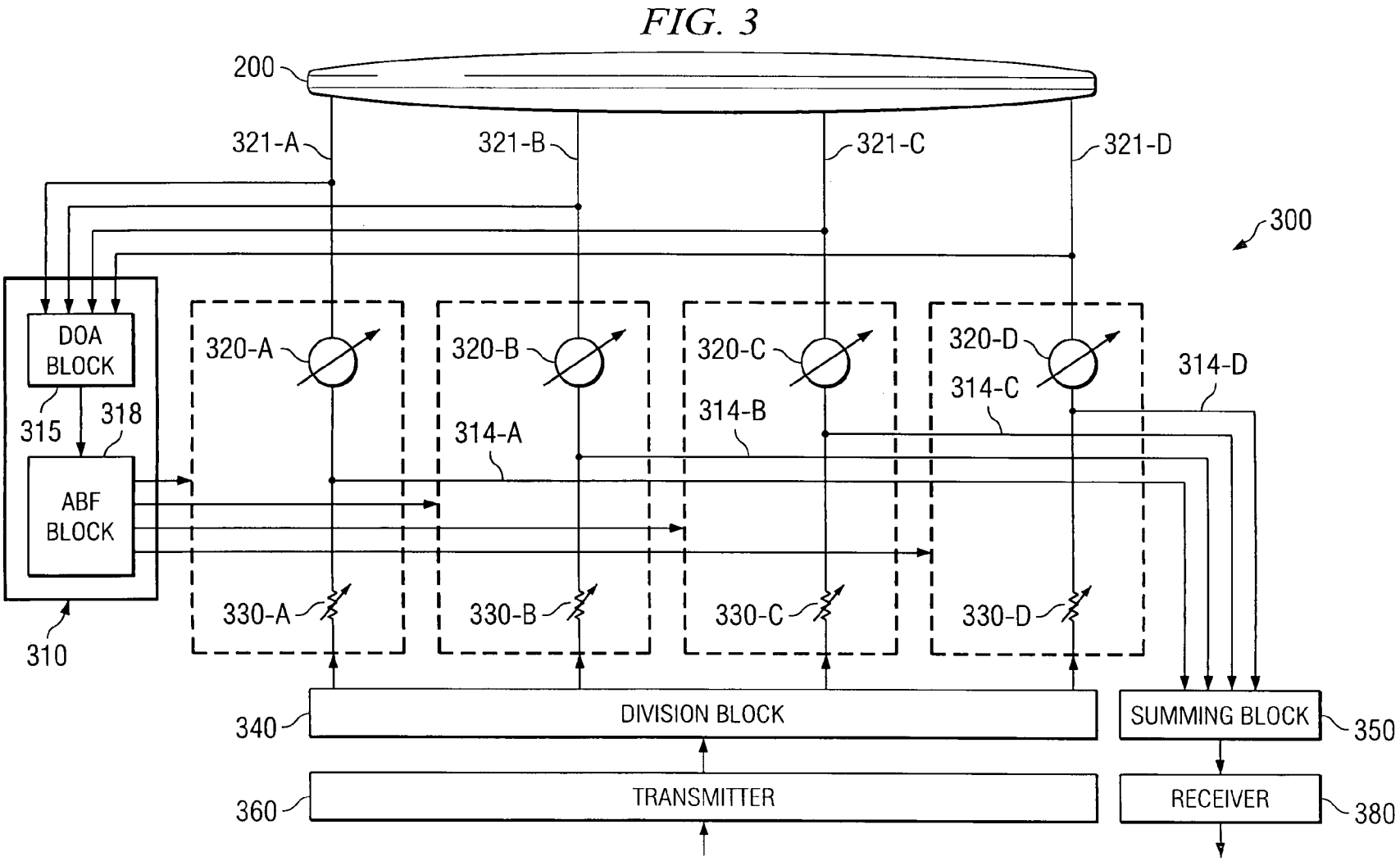
FIG. 3 is a block diagram illustrating an example device implemented according to an aspect of the present invention.

FIG. 3 is a block diagram illustrating the details of an example device implemented according to an aspect of the present invention. Base station 300 is shown containing antenna 200 (represented in the form of a lens), processing block 310, phase shifters 320-A through 320-D, attenuators 330-A through 330-D, division block 340, summing block 350, transmitter 360, and receiver 380. It may be appreciated that base station 300 is described as being used in the intersection of FIG. 1 and thus antenna 200 is shown as being a part of base station 300.

Antenna 200 receives radio signals, generates the corresponding electrical signals, and provides the electrical signals on paths 321-A through 321-D (to control blocks containing phase shifters and attenuators). Only four paths are shown assuming that antenna 200 contains four antenna elements. Similarly, antenna 200 receives electrical signals on paths 321-A through 321-D, and generates the corresponding electromagnetic waves for transmitting the contained application data (voice, data, video etc.). As may be appreciated, direction of the beam and the range of illumination is determined based on the signals provided to antenna elements and collimation provided by the lens.

Processing system 310 is shown containing DOA (direction of arrival) block 315 and ABF (adaptive beam formation) block 318. DOA block 315 examines the signals on paths 321-A through 321-D to estimate the direction of the active mobile nodes, and also the extent of calibration required due to the different spatial coordinates as well as imperfections of each antenna element (which causes signals originating from the same location to be received at different times). The estimates are provided to ABF block 318.

ABF block 318 determines the phase and attenuation factor values that need to be provided to phase shifters (320-A through 320-D) and attenuators (330-A through 330-D) based on the estimates provided by DOA block 315. DOA 315 and ABF 318 may be implemented in a known way.

Summing block 350 receives signals (representing each active channel) on paths 314-A through 314-D, and generates a broadband signal containing all the active channels. The broadband signal is forwarded to receiver 380. Receiver 380 processes the broadband signal to perform operations such as down-conversion and amplification, and the resulting baseband signal is forwarded to a corresponding application (e.g., voice switch). Receiver 380 and summing block 350 may be implemented in a known way.

Transmitter 360 receives a baseband signal corresponding to an application and generates a broadband signal in the frequency range suitable for transmission by the antenna elements. Division block 340 generates electrical signals suitable for processing by antenna elements from the broadband signal, and the generated signals are passed via corresponding phase shifter and attenuator circuits. Transmitter 360 and division block 340 may be implemented in a known way.

Each of attenuators 330-A through 330-D attenuates the signal received from division block 340 (under the control of ABF block 318) and provides the attenuated signal to a corresponding one of phase shifters 320-A through 320 -D. Each phase shifter 320-A through 320-D shifts the corresponding input signal by an amount determined ABF block 318, and the shifted signal is provided to the corresponding antenna element.

The antenna elements contained in antenna 200 generate a beam corresponding to the signals received on paths 321-A through 321-D. The beam is collimated by the lens as described above with reference to FIGS. 1A, 1B, and 2B. As noted above, the lens needs to be designed carefully for the proper operation of antenna 200. The manner in which the lens can be implemented is described below in further detail.

5. Implementing the Lens

Figure 4:
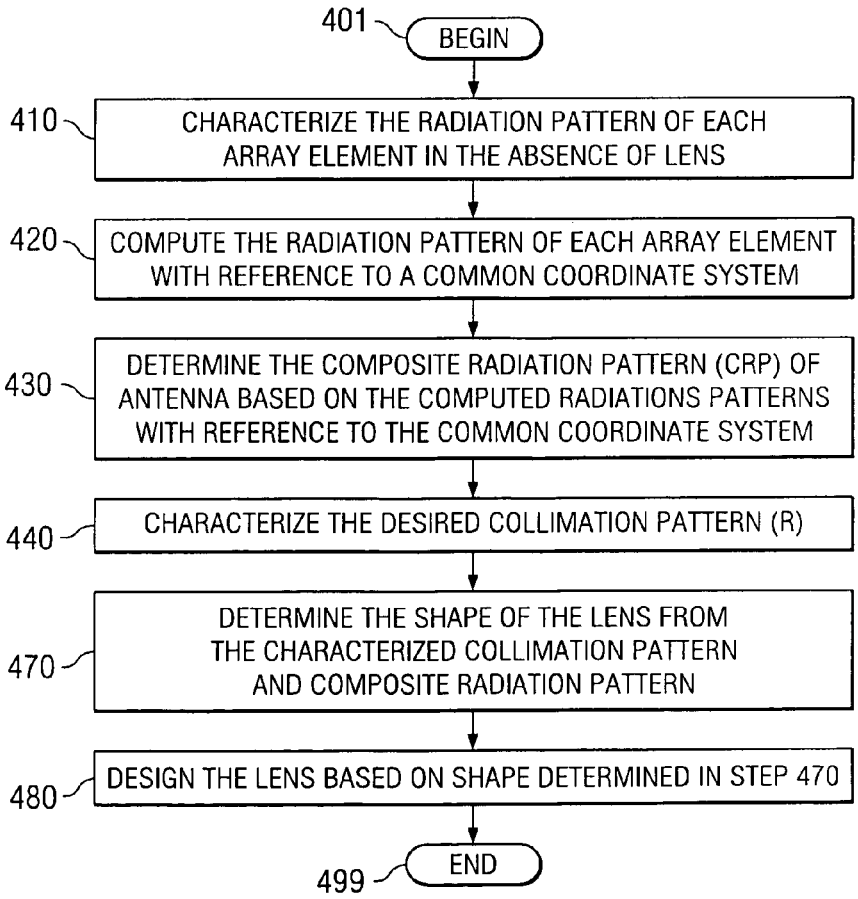
FIG. 4 is a flow-chart describing the manner m which a lens may be designed according to an aspect of the present invention.

FIG. 4 is a flow-chart describing the manner in which a lens can be designed according to an aspect of the present invention. For illustration, the method is described with reference to FIGS. 1A, 1B and 2B. However, the approach may be used in various other environments without deviating from the scope and spirit of several aspects of the present invention. The method begins in step 401 in which control immediately passes to step 410.

In step 410, radiation pattern of each array element in the absence of lens is characterized with reference to a corresponding coordinate system (i.e., having a corresponding origin). In one embodiment, the radiation pattern caused due to each array element is modeled as a spherical modal expansion. As is well known in the relevant arts, the radiation pattern contains electric (E) and magnetic (H) components. The radiation pattern of an array element at any given point is then given according to the following equations:

$$Ei(R, \theta, \phi) = \sum_n (a_{in} M_{mn} + b_{in} N_{mn}) \quad \text{Equation (1)}$$

$$Hi(R, \theta, \phi) = jY_0 \sum_n (a_{in} N_{mn} + b_{in} M_{mn}) \quad \text{Equation (2)}$$

wherein Ei represents the electric radiation in the absence of the lens, Hi represents the magnetic radiation in the absence of the lens, $a_{in}$ and $b_{in}$ represent the coefficients according to the spherical modal expansion for an array element, R represents a radial distance from the array element to a point at which field strength is determined, θ and ϕ respectively represent elevation and azimuth angles of a coordinate system of the array element as is well known in the relevant arts, $Y_0$ represents characteristic admittance of free space, j represents the complex number equaling square root of minus 1, 'm' represents the azimuthal modal index, 'n' represents the modal harmonic number, and $M_{mn}$ and $N_{mn}$ are representations of the orthogonal spherical modal harmonics and can be determined in a known way.

The radiation pattern at multiple points in the near field is measured (e.g., using a probe) or computed by accurate theoretical means in a known way. The measured field may then be used to compute the expansion coefficients ($a_{in}$ and $b_{in}$), and thus determine the radiation pattern of each array element in the corresponding coordinate system.

In step 420, the radiation pattern of each array element is computed with reference to a common coordinate system. That is, a common coordinate system is chosen, and the values computed in step 410 are transformed to correspond to the common coordinate system. The same common coordinate system may be used with respect to lens as well. The computations may be performed, for example, by using translation and rotation derivations for the spherical harmonics computed in step 410, as described below.

First, a translation derivation is performed on the coefficients of radiator and the resulting electrical field (Et) and magnetic field (Ht) is shown in Equations (3) and (4) below.

$$Et(R, \theta, \phi) = \sum_n (A_{in} M_{mn} + B_{in} N_{mn}) \quad \text{Equation (3)}$$

$$Ht(R, \theta, \phi) = -jY_0 \sum_n (A_{in} N_{mn} + B_{in} M_{mn}) \quad \text{Equation (4)}$$

wherein $A_{in}$ and $B_{in}$ are the translated radiator coefficients and are respectively represented by Equations (5) and (6).

$$A_{in} = \sum_V (A_v^n a_{iv} + B_v^n b_{iv}) \quad \text{Equation (5)}$$

$$B_{in} = \sum_V (B_v^n a_{iv} + A_v^n b_{iv}) \quad \text{Equation (6)}$$

wherein $A_v^n$ and $B_v^n$ are the translation coefficients, and $a_{iv}=a_{in}$ and $b_{iv}=b_{in}$ are the radiator coefficients in the original untranslated coordinate system of step 410.

The translated coefficients can be further rotated using rotational derivations, and Equations (7) and (8) shown below respectively represent the translated and rotated electrical component (Etr) and magnetic component (Htr).

$$Etr = \sum_n^{\alpha} \sum_{m=-n}^{n} \{F_{mn} M_{mn}(R, \theta, \phi) + G_{mn} N_{mn}(R, \theta, \phi)\} \quad \text{Equation (7)}$$

$$Htr = (K/-jY_o) \sum_n^{\alpha} \sum_{n=-n}^{n} \{F_{mn} N_{mn}(R, \theta, \phi) + G_{mn} M_{mn}(R, \theta, \phi)\} \quad \text{Equation (8)}$$

wherein $F_{mn}$ and $G_{mn}$ respectively represent the radiators translated-rotated coefficients referred to the common coordinate system with origin at O and are respectively shown in Equations(9) and (10).

$$F_{mn} = \sum_{v=1}^{\alpha} \sum_{\mu=-v}^{v} \{A_{\mu v} C(\mu, v/m, n) + B_{\mu v} D(\mu, v/m, n)\} \quad \text{Equation (9)}$$

$$G_{mn} = \sum_{v=1}^{\alpha} \sum_{\mu=-v}^{v} \{A_{\mu v} D(\mu, v/m, n) + B_{\mu v} C(\mu, v/m, n)\} \quad \text{Equation (10)}$$

wherein A's, B's represent translation coefficients, C's and D's represent rotation coefficients, μ,v respectively represent the modal indices.

In step 430, composite radiation pattern (CRP) of antenna 200 is determined based on the computed radiations patterns with reference to the common coordinate system. CRP can be represented as a function (f) of coefficients $a_{in}$ and $b_{in}$ and is represented as shown in Equation (11) below.

$$CRP = f1(a_{in}, b_{in}) \quad \text{Equation (11)}$$

In step 440, the desired collimation pattern (DCP) is characterized. In one embodiment, collimation pattern may be characterized by electromagnetic field in the far field. Such far field representation (R=constant,θ,ϕ) may be represented by the scattered spherical modal expansion coefficients ($X_{mn}$ and $Y_{mn}$) external to dielectric lens (determined by applying the appropriate boundary conditions). The collimation may be represented by Equation (12) below.

$$DCP = f2(X_{mn}, Y_{mn}) \quad \text{Equation (12)}$$

In step 470, the shape of the lens is determined from the characterized collimation pattern and composite radiation pattern. For example, assuming that the desired shape of the lens is given by Equation (13) below, inverse scattering technique well known in the relevant arts can be applied in accordance with equations (14) and (15) to determine the desired shape of the lens.

$$\text{Shape}=f3(R,\theta,\phi) \quad \text{Equation (13)}$$

$$f3(R,\theta,\phi)\times f1(a_{in}, b_{in})=f2(X_{mn}, Y_{mn}) \quad \text{Equation (14)}$$

$$f3(R,\theta,\phi)=f1^{-1}(a_{in}, b_{in})\times f2(X_{mn}, Y_{mn}) \quad \text{Equation (15)}$$

In step 480, lens is designed based on shape (f3) determined in step 470. In an embodiment, lens parameters such as permittivity, permeability and loss tangent of the dielectric material, are embedded in computation of f2. The values are entered for known dielectrics with constant permeability, and low loss tangent. The method ends in step 499.

Thus, using the principles described above, a lens that will collimate the beam in the direction of high density of subscribers may be implemented.

6. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A base station comprising:

an antenna containing a plurality of antenna elements and at least one lens, wherein said plurality of antenna elements generate a beam and said lens collimates said beam in a desired direction such that said base station sends signals in said desired direction;

a transmitter receiving a baseband signal and generating broadband signal in a frequency range suitable for transmission by said antenna;

a divider receiving said broadband signal and generating an input signal for each of said plurality of antenna elements; and an attenuator and a phase shifter connected in series between said divider and one of said plurality of antenna elements, said attenuator attenuating said input signal and said phase shifter shifting a phase of said input signal.

2. The base station of claim 1, wherein said desired direction comprises a direction in which a high density of wireless users are expected to be present.

3. The base station of claim 2, wherein said direction is along a road.

4. The base station of claim 1, comprising a plurality of lens including said lens, wherein each of said plurality of lens is provided in a corresponding direction.

5. The base station of claim 1, further comprising:

a summing block receiving a plurality of electrical signals from said antenna elements and generating a broadband signal; and a receiver block generating a baseband signal from said broadband signal.

6. A method of designing a lens located on top of a plurality of array elements in an antenna, said antenna generating a desired collimation pattern for radiations generated by said plurality of array elements, said method comprising:

determining a first radiation pattern of each of said plurality of array elements in the absence of said lens;

determining a second radiation pattern of each of said plurality of array elements based on said first radiation pattern, wherein said second radiation pattern is computed with reference to a common origin for all of said plurality of array elements;

computing a composite radiation pattern (CRP) of said antenna based on said second radiation pattern for each of said plurality of array elements;

characterizing said desired collimation pattern in the presence of said lens; and determining a shape of said lens is determined from the characterized collimation pattern and said CRP.

7. The method of claim 6, wherein said first radiation pattern and said second radiation pattern are modeled according to a spherical modal approach, wherein said first radiation pattern contains a first plurality of coefficients and said second radiation pattern contains a second plurality of coefficients.

8. The method of claim 7, wherein said first plurality of coefficients are determined by measuring a radiation at a radius R.

9. The method of claim 8, wherein said second plurality of coefficients are determined by performing translation and rotation operations on said first radiation pattern.

10. The method of claim 9, wherein said shape of said lens is determined by performing an inverse scattering operation using said CRP and said desired collimation pattern.

11. An antenna configured to generate a desired collimation pattern comprising:

a plurality of antenna elements configured to generate a beam; and at least one lens configured to collimate said beam in a desired direction such that the antenna sends and receives signals from the desired direction, wherein a shape of the lens is determined using a composite radiation pattern of the antenna and the desired collimation pattern.

12. An antenna according to claim 11, wherein the composite radiation pattern of the antenna is determined according to a radiation pattern of each of the plurality of antenna elements.

13. An antenna according to claim 12, wherein the radiation pattern of each of said plurality of antenna elements is determined with reference to a common origin of the radiation pattern of the plurality of antenna elements.

14. A method of determining shape of a lens for an antenna, the antenna comprising a plurality of antenna elements, the method comprising:

determining a pattern of radiation for each one of the plurality of antenna elements with reference to a common origin for the plurality of antenna elements;

computing a composite radiation pattern for the antenna based on the pattern of radiation;

characterizing a desired collimation pattern for the radiation using the lens; and determining the shape of the lens using the characterized collimation pattern and the composite radiation pattern.

15. A method according to claim 14, wherein the pattern of radiation is determined based on radiation patterns of each one of the plurality of antenna elements without the lens.

16. A method according to claim 14, wherein the shape of the lens is determined by performing an inverse scattering operation using the composite radiation pattern and the desired collimation pattern.

17. A lens for an antenna, the lens having a shape that is determined by characterizing a desired collimation pattern for the antenna and a composite radiation pattern of a plurality of antenna elements.

18. A lens according to claim 17, wherein the composite radiation pattern is determined based on a radiation pattern for the plurality of antenna elements, the radiation pattern being determined with reference to a common origin for the plurality of antenna elements.

* * * * *